US005176156A

United States Patent [19]

Ashtary et al.

[11] Patent Number: 5,176,156

[45] Date of Patent: Jan. 5, 1993

[54] MASCARA APPLICATOR AND EYELASH BRUSHING AND CURLING DEVICE

[76] Inventors: Parvis N. Ashtary; Setti Hossaini, both of 6600 Beachview Dr. #306, Rancho Palos Verdes, Calif. 90274

[21] Appl. No.: 705,286

[22] Filed: May 24, 1991

[51] Int. Cl.[5] ..... A45D 40/26

[52] U.S. Cl. ..... 132/218; 132/217

[58] Field of Search ..... 132/216, 217, 218, 320; 401/10, 34, 39, 122, 126, 127, 129

[56] References Cited

U.S. PATENT DOCUMENTS

| | | | |
|---|---|---|---|
| 1,795,482 | 3/1931 | Ehmann | 132/218 |
| 1,905,399 | 4/1933 | Wagner | 132/218 |
| 2,136,779 | 11/1938 | Bednar | 132/218 |
| 2,252,551 | 8/1941 | Brollier et al. | 132/320 |
| 2,323,595 | 7/1943 | Hanisch | 401/10 |
| 4,280,518 | 7/1981 | Gambaro | 132/323 |
| 4,458,701 | 7/1984 | Holland | 132/218 |
| 4,600,328 | 7/1986 | Clements | 401/129 |
| 5,007,442 | 4/1991 | Hirzel | 132/218 |

FOREIGN PATENT DOCUMENTS

| | | | |
|---|---|---|---|
| 776191 | 1/1935 | France | 132/218 |

*Primary Examiner*—Gene Mancene
*Assistant Examiner*—Frank A. LaViola
*Attorney, Agent, or Firm*—Fulwider Patton Lee & Utecht

[57] ABSTRACT

A device for applying mascara and curling and brushing an eyelash includes a scissors mechanism having a first handle with an arm extending therefrom and a second handle having an arm extending therefrom, the two handles being pivotally connected together. Each arm of the scissors mechanism includes a brushlike element which is adapted to retain an amount of mascara for application to the eyelid and is also capable of curling the eyelash when the eyelash is placed between the two brushlike elements and the brushlike elements are brought in contact with one another.

3 Claims, 1 Drawing Sheet

MASCARA APPLICATOR AND EYELASH BRUSHING AND CURLING DEVICE

BACKGROUND OF THE INVENTION

1. Field of the Invention

The present invention relates generally to devices for applying cosmetics, and more particularly, to a device capable of applying mascara to an eyelash while simultaneously curling the eyelash.

2. Description of the Prior Art

A mascara applicator is a well known cosmetic device used for applying a cosmetic preparation known as mascara to one's eyelash for temporarily coloring or darkening the eyelash to provide a fuller looking appearance. Most mascara applicators consist of a handheld stick or "wand" which has a brush located at one end. This brush is adapted to receive an amount of mascara which can then be applied by stroking the brush across the eyelash. Since the brush includes a number of outwardly projecting filaments, it can hold a sufficient amount of mascara for application. These projecting filaments are spaced apart to enable the individual hairs of the eyelash to contact at least one or more filaments which retains the mascara, which then gets transferred to the eyelash as the filaments pass over the individual lashes. Thus, the eyelash receives a supply of mascara to darken the lash, and in some cases, to artificially lengthen the lash to provide an even fuller appearance.

Application of mascara to the eyelash is not the only cosmetic procedure that can be used to enhance the beauty and appearance of the eyelash. For example, it is somewhat fashionable for a person to have a curly eyelash. For some, curly eyelashes come naturally, for others, curly lashes can only be obtained by artificially curling them.

An eyelash curler generally includes a pair of movable jawlike elements between which the eyelash is placed for curling. The elements are brought together to squeeze the eyelash therebetween causing the lash to curl in an outwardly and upwardly extending manner. This curling procedure can cause the eyelash to remain curled for several hours to several days.

It is often desirous to have both curly eyelashes that are further enhanced in appearance by an application of mascara. One of the problems associated with conventional eyelash curling devices is the fact that they often must be utilized before any mascara is applied to the eyelash since the movable elements of the device can cause the mascara to spread to the user's eyelid or in the area surrounding the eye, which is detrimental. Since other cosmetics may already be applied to the eyelid and generally around the eye of the user, any unwanted spread of mascara by the curler can ruin the application of the other cosmetics causing the user to reapply the cosmetics.

In the event that a person wishes to recurl eyelashes which already have mascara applied on them, the person must carefully use the curler to avoid the spread of mascara; however, the risk of spreading mascara to unwanted areas around the eye is still present. Therefore, there is a need for a curling device that can be used to curl an eyelash which already has mascara applied to it. Such a device would even be more useful if it could simultaneously apply new mascara to the eyelash when the curling is performed.

SUMMARY OF THE INVENTION

In general terms, the present invention is directed to a novel device for applying mascara and curling an eyelash which includes a scissors mechanism having a first handle with an arm extending therefrom with means, such as a brush or brushlike element, attached to the end of the arm for retaining an amount of mascara that can be transferred to the eyelash. The device includes a second similar handle with an extended arm which has similar means, such as a brush, attached to the end of the arm for applying the mascara. The handles are pivotally connected with each other to form the scissors mechanism.

These brushlike elements come in contact with each other through the manipulation of the scissors mechanism. In use, the person places the eyelash in between the two movable brushlike elements and manipulates the scissors mechanism to bring the two brushlike elements in contact with one another. This causes a transfer of the mascara onto the eyelash and causes the eyelash to curl upwards. A sufficient amount of pressure has to be exerted on the handles of the scissors mechanism to allow the brushlike elements to "squeeze" or reorientate the shape of the eyelash to cause the eyelash to curl. The user can also use an outward upward stroke when removing the device to further enhance the curling of the eyelash and to brush the eyelash.

In one preferred embodiment, each brushlike element is made from a number of individual filaments which have sufficient rigidity to allow the eyelash to be curled once the two brushlike elements are brought together and a sufficient amount of force is applied with the handles. Also, these brushlike elements can be arced upward along its longitudinal axis to further enhance the ability of the device to curl the eyelash.

In another form of the invention, these brushlike elements are formed with a sleevelike member which can be placed on each arm of the scissors mechanism. The sleevelike member includes a detent mechanism which can be placed within a notch found on the arm of the scissors mechanism to maintain the brushlike element on the arm. Utilizing such a construction, the user can simply remove the brushlike members when they become worn and can replace them with new ones.

The features and advantages of the present invention will become more apparent from the foregoing detailed description taken in conjunction with the accompanying drawings which illustrate by way of example the principle of the present invention.

DETAILED DESCRIPTION OF THE PREFERRED EMBODIMENTS

The present invention provides a novel approach in applying mascara to an eyelash and also curling the eyelash simultaneously, thus eliminating the need for two different cosmetic devices for performing these dual functions. As a result, the present invention can be easily used to recurl eyelashes that already have mascara applied on them without the fear of spreading the mascara in the region surrounding the eyelash.

Figure 1:
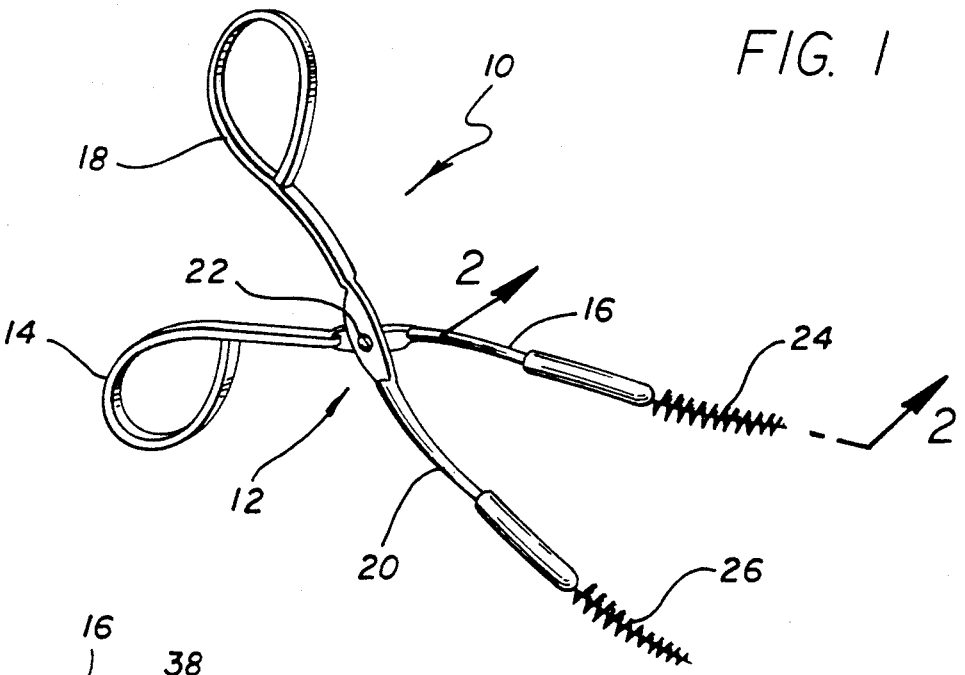
FIG. 1 is a perspective view of one embodiment of a mascara applicator and eyelash curling device made in accordance with the present invention.

FIG. 1 shows one particular embodiment of the a mascara applicator and eyelash curling device made in accordance with the present invention. The eyelash device 10 is shown as a scissors mechanism 12 which includes a first handle 14 having an outwardly extending arm 16. The mechanism 12 also includes a second handle 18 with a similarly outwardly extending arm 10. These first and second handles 14 and 20 are in turn pivotally connected to each other via a pin 22 or similar fastening device which allows the handles to pivot relative to one another.

The arm 16 further includes means shown as a brushlike element 24 attached thereto for retaining an amount of mascara which is to be applied to the eyelash. Similarly, the arm 20 has similar means, such as the brushlike element 26, attached to it for retaining a sufficient amount of mascara which is to be applied to the eyelash as well. It should be appreciated that these means for applying the mascara can be brushes or brushlike elements or any other similar elements which are capable of applying mascara and curling the eyelash when the elements are brought together via the scissors mechanism.

Figure 5:
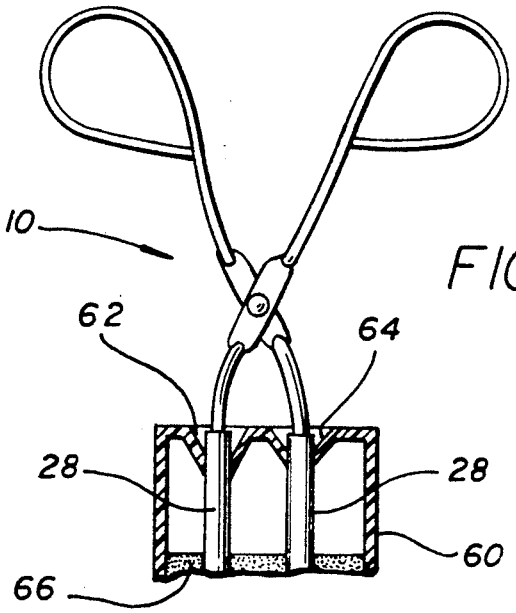
FIG. 5 is a partial cross-sectional fragmented view of one embodiment of the present invention as it is placed in the mascara receptacle.

In use, the user simply grasps handles 14 and 18 of the device and places the device in a receptacle, such as the one shown in FIG. 5, to place a sufficient amount of mascara preparation on the brushlike elements. Thereafter, the user positions the eyelash between the two brushlike elements 24 and 26 and manipulates the scissors to bring the elements 24 and 26 together. When the two brushlike elements contact each other, the eyelash which is positioned between the elements, is "squeezed" or "bent" in a somewhat arcuate fashion causing the eyelash to curl upward from the eyelid. These brushlike elements also apply the mascara simultaneously to the eyelash as they are full with the mascara preparation. The user simply has to squeeze the handles of the scissors mechanism to cause the eyelash in between the two brushlike elements to curl. Thereafter, the user simply can provide an outward and upward stroke away from the eyelid to further enhance the curling of the lashes and assure that the mascara is evenly applied to the eyelash.

It should be appreciated that the fibers or filaments which make up the brushlike element must be sufficiently strong enough to apply a force on the eyelash to curl it. If the filaments are too soft, there is a possibility that the device would not be able to properly curl the device once the brushlike elements are brought together. Also, the brushlike elements can be slightly arched concavely along its longitudinal axis to further enhance the device's ability to curl the eyelash (see FIG. 2).

Figure 2:
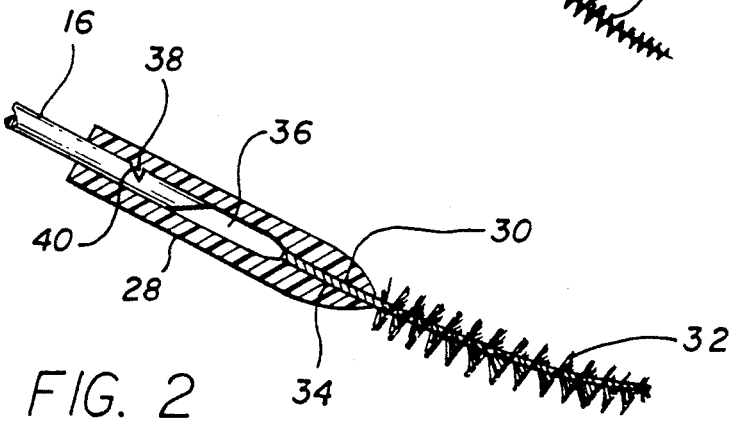
FIG. 2 is a partial cross-sectional view of the sleevelike member and brushlike element connected to the arm of the scissors mechanism taken along line 2—2 of FIG. 1.

Referring now to FIG. 2, a cross-sectional view of the particular embodiment of FIG. 1 is shown in greater detail. In the particular embodiment shown in FIGS. 1 and 2, each of these brushlike elements are formed as an integral unit with a sleevelike member 28 which holds the brush element 24. As can be seen in greater detail in FIG. 2, the brush 24 has a central wire or core 30 from which the individual filaments 32 of the brushlike element is formed. This wire 30 is in turn securely connected within an opening 34 formed in the sleevelike member 28 by using appropriate means such as adhesives or similar fastening means.

This sleevelike member 28 in turn has a larger internal opening 36 which receives the arm 16 of the scissors mechanism. The sleevelike member 28 further includes means, such as a detent mechanism 38, for securing the member and brushlike element on the arm of the scissors. This detent member 38 is adapted to fit within a notch 40 formed on the arm 16 which helps maintain the brushlike element on the arm of the scissors. It will be appreciated that the same sleevelike member and brush element can be implemented on the second arm 20 of the scissors mechanism. Also, this sleevelike member could be formed with an opening 36 which would receive the particular shape of the arm.

The use of this sleevelike member to hold the brushlike element allows the user to replace the brushes when the filaments of the brush become worn through use. The user simply has to pull the sleevelike members off the arms of the scissors mechanism (which may require some force) and replacement sleeves and brushes can then be replaced on the arms of the scissors to have a fully operable device. It should be appreciated that the arms of the scissors mechanism can extend directly outward to the brush elements, where the filaments can actually be placed on the arms of the scissors mechanism, using different construction. In the broadest sense, each arm can be constructed in one single piece with the filaments that form the brushlike elements placed directly on each arm. The use of the sleeve member assembly shown in FIGS. 1 and 2 merely provides one way of easily manufacturing the particular embodiment and provides the ability to interchange brush elements when necessary.

Figure 3:
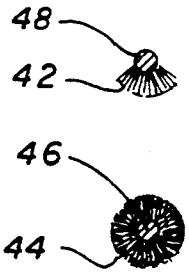
FIG. 3 is a side view of upper and lower brushlike elements made in accordance with the present invention.
Figure 4:
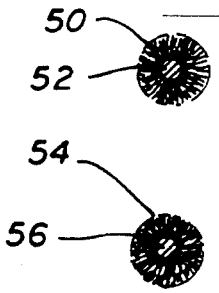
FIG. 4 is a side view of upper and lower brushlike elements made in accordance with the present invention.

Referring now to FIGS. 3 and 4, a side elevational view of the ends of the brushlike elements are shown. In FIG. 3, an upper brush element 42 is shown having filaments extending only downward towards the second brush element 44. This bottom or second brushlike element 44 has filaments which surround the wire component 46 in a 360° pattern. The advantages of using an upper element which only has filaments extending partially around the wire 48 prevents the possibility that mascara could possibly be smeared on the eyelid during usage. The lack of filaments on the upper portion of this brush element 42 thus prevents this from occurring.

Referring now to FIG. 4, the upper brushlike element 50 is shown having full filaments around the wire 52. Similarly, the bottom brushlike element 54 is similarly designed with filaments attached in 360° around the wire element 56.

Referring now to FIG. 5, the eyelash device 10 is shown as it is place in a mascara receptacle 60. This mascara receptacle is shown in a cross-sectional fragmented view which shows the receptacle including a pair of conically shaped openings 62 and 64 which receive the arms and sleevelike members of the eyelash device. The use of these conically shaped openings allows the mascara receptacle to be sufficiently closed when not in use to prevent drying of the mascara preparation. As can be seen in FIG. 5, the sleevelike members of the device are press fitted against these openings to seal the receptacle during non-use. Mascara 66 is shown as it contained within the receptacle 60.

The present invention can be made from any number of different materials such as metals or plastics to form the scissors mechanism. The sleevelike members can also be made from an inexpensive material such as plastic to help reduce the manufacturing costs of the device. The filaments that make up the brushlike elements can be made from a number of different materials such as nylon, natural fibers and similar filament material provided the filament has sufficient strength to curl the eyelash when the brush elements are brought together.

From the above, it is evident that the present invention provides a novel approach for applying mascara and curling an eyelash through the use of one specialized device. The present invention is superior over prior art devices since it eliminates the need for two separate cosmetic devices for applying the mascara and then curling the eyelash. The present invention also prevents mascara from smearing to the area around the eyelid during usage. By utilizing the present invention, one can simultaneously curl and apply mascara with a relatively simple-to-operate device.

While particular forms of the present invention have been described and illustrated, it will be also apparent to those skilled in the art that various modifications may be made without departing from the spirit and scope of the invention. Accordingly, it is not intended that the invention be limited except by the appended claims.

What is claimed is:

1. A device for curling, brushing and applying mascara to an eyelash, comprising:

a first handle having an arm extending therefrom;

a second handle having an arm extending therefrom, said first and second handles being pivotally connected to form a scissors mechanism;

a first sleevelike member including first and second ends, said first end having an opening defined therein for receiving at least a portion of said arm of said first handle, said first sleeve-like member extending substantially in the same longitudinal axis with said arm and including a brushlike element extending from said second end for retaining an amount of mascara for transfer to the eyelash;

means for securing said first sleevelike member to said arm of said first handle;

a second sleevelike member including first and second ends, said first end having an opening defined therein for receiving at least a portion of said arm of said second handle, said second sleeve-like member extending substantially in the same longitudinal axis with said arm and including a brushlike element extending from said second end for retaining an amount of mascara for transfer to the eyelash, wherein said brushlike elements of said first and second sleevelike members are adapted to curl an eyelash when brought together; and means for securing said second sleevelike member to said arm of said second handle.

2. The device as defined in claim 1 wherein each brushlike element comprises a central core which holds individual filaments and each sleevelike member has an opening at said second end for receiving and holding said central core.

3. A device for curling, brushing and applying mascara to an eyelash, comprising:

a first handle having an arm extending therefrom;

a second handle having an arm extending therefrom, said first and second handles being pivotally connected to form a scissors mechanism;

a first brushlike element having a central core which holds individual filaments for retaining an amount of mascara for transfer to the eyelash;

means for securing said central core of said first brushlike element to said arm of said first handle;

a second brushlike element having a central core which holds individual filaments for retaining an amount of mascara for transfer to the eyelash;

means for securing said central core of said second brushlike element to said arm of said second handle.

* * * * *